US008480502B2

(12) United States Patent
Korte

(10) Patent No.: US 8,480,502 B2
(45) Date of Patent: Jul. 9, 2013

(54) WRIST ROTATION CONTROLLER FOR BOWLERS

(76) Inventor: Jay S. Korte, Celina, OH (US)

( * ) Notice: Subject to any disclaimer, the term of this patent is extended or adjusted under 35 U.S.C. 154(b) by 0 days.

(21) Appl. No.: 12/657,946

(22) Filed: Jan. 29, 2010

(65) Prior Publication Data

US 2010/0298059 A1 Nov. 25, 2010

Related U.S. Application Data

(60) Provisional application No. 61/213,274, filed on May 22, 2009.

(51) Int. Cl.
*A63B 69/00* (2006.01)

(52) U.S. Cl.
USPC ..... 473/62; 602/21

(58) Field of Classification Search
USPC ..... 473/61–63, 212, 213, 458, 464; 602/21, 602/22; 128/880
See application file for complete search history.

(56) References Cited

U.S. PATENT DOCUMENTS 3,036,831 A 5/1962 Engan
3,880,426 A * 4/1975 Morse ..... 473/61
4,333,647 A 6/1982 Schaefer
4,628,918 A * 12/1986 Johnson, Jr. ..... 602/13
4,632,105 A * 12/1986 Barlow ..... 602/64
4,895,373 A * 1/1990 Richmon ..... 473/215
4,919,425 A * 4/1990 Wolf ..... 473/450
5,228,682 A * 7/1993 Wolf ..... 473/450
5,685,787 A * 11/1997 Kogut ..... 473/409
6,196,931 B1 * 3/2001 Wilt ..... 473/212
6,203,453 B1 * 3/2001 Coddens ..... 473/450
7,442,133 B2 * 10/2008 Wolf ..... 473/450

* cited by examiner

*Primary Examiner* — William Pierce
(74) *Attorney, Agent, or Firm* — Jacox, Meckstroth & Jenkins

(57) ABSTRACT

A wrist rotation controller for a bowler is attached to the arm and thumb of the bowler to restrict or enhance wrist rotation during release of a bowling ball. The controller includes an adjustable band adapted to extend around the arm of the bowler at a position just below the elbow. An elongated non-stretchable strap has an upper end portion for removable and adjustable attachment to the band and a lower end portion having a non-stretchable loop for extending around the thumb of the bowler. When properly positioned on the arm and thumb of the bowler, the controller restricts or enhances rotation of the wrist and ball during release of the ball. The band and the strap have hook and loop fasteners commonly sold under the trademark VELCRO to provide the adjustment of the band on the arm and the strap on the band.

4 Claims, 4 Drawing Sheets

WRIST ROTATION CONTROLLER FOR BOWLERS

RELATED APPLICATION

This application claims the benefit of U.S. Provisional Patent Application Ser. No. 61/213,274, filed May 22, 2009.

BACKGROUND OF THE INVENTION

The present invention relates to sports equipment and more specifically, to a wrist rotation controller for bowlers by restricting or enhancing wrist rotation during the release of a bowling ball.

One must master the mechanics of bowling to become a first-rate bowler. The mechanics include among other things, the proper footwork in the approach, the back swing, the position of the bowler's head and upper torso and the position of the wrist when the ball is released. Hours of practice are required so that performance is routine and the mechanics are consistent in frame after frame. A major hindrance to achieving a routine performance is maintaining a consistent wrist position during ball release. Unintentional over-rotation or under-rotation of the wrist during release can result in erratic ball movement, causing the bowling ball to deviate from its intended path and thus missing the target. Even hours of practice often will not prevent the natural tendency to over rotate or under rotate the wrist. Thus the present invention is directed to the need of an amateur bowler for a device which controls rotation of the wrist during release of a bowling ball.

SUMMARY OF THE INVENTION

In accordance with the invention, a flexible device extends around the arm and the gripping thumb of a bowler and prevents the wrist from over rotating or under rotating during release of the bowling ball. The device includes an adjustable flexible band adapted to be wrapped around the ball support arm of the bowler at a position adjacent and just below the elbow. A flexible strap has a free end adapted for removable and adjustable attachment to the band. The opposite or second end portion of the strap connects with a loop for receiving and extending around the thumb which grips the bowling ball. When properly positioned on the arm and thumb of the bowler, the device will prevent either over rotation of the wrist or enhance wrist rotation during ball release according to the position of the device on the arm and thumb.

Thus, the device of the invention functions to improve the delivery of a bowling ball, thereby contributing to an improvement in scoring. The device consists of a minimum number of components or parts, is easy to position on the thumb and arm and is comfortable to wear. The parts are inexpensive, dependable and fully effective in accomplishing their intended purposes.

These and other features and advantages of the present invention will become readily apparent from the following description, drawings and the appended claims.

DETAILED DESCRIPTION OF THE PREFERRED EMBODIMENTS

Figure 1:
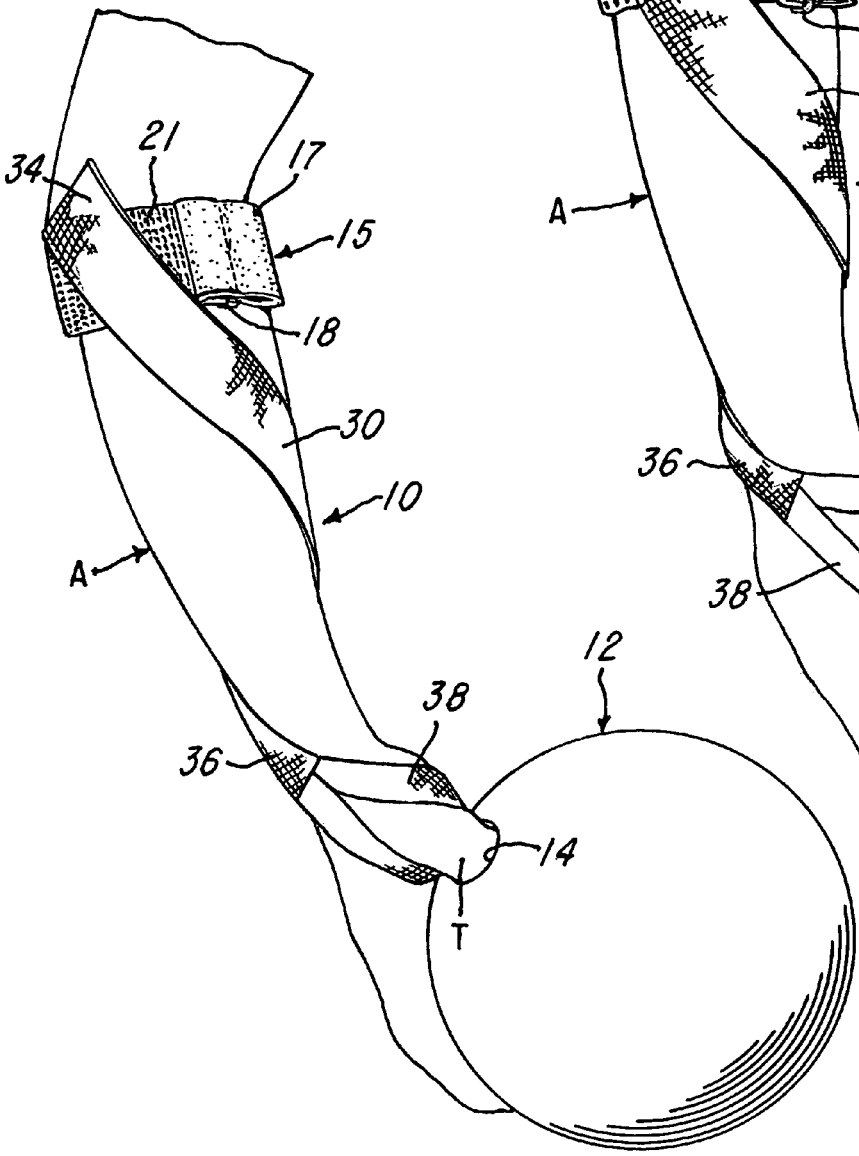
FIG. 1 is a perspective view of a bowler's right arm supporting a bowling ball and having a wrist rotation controller attached to the arm and thumb in accordance with the invention.
Figure 2:
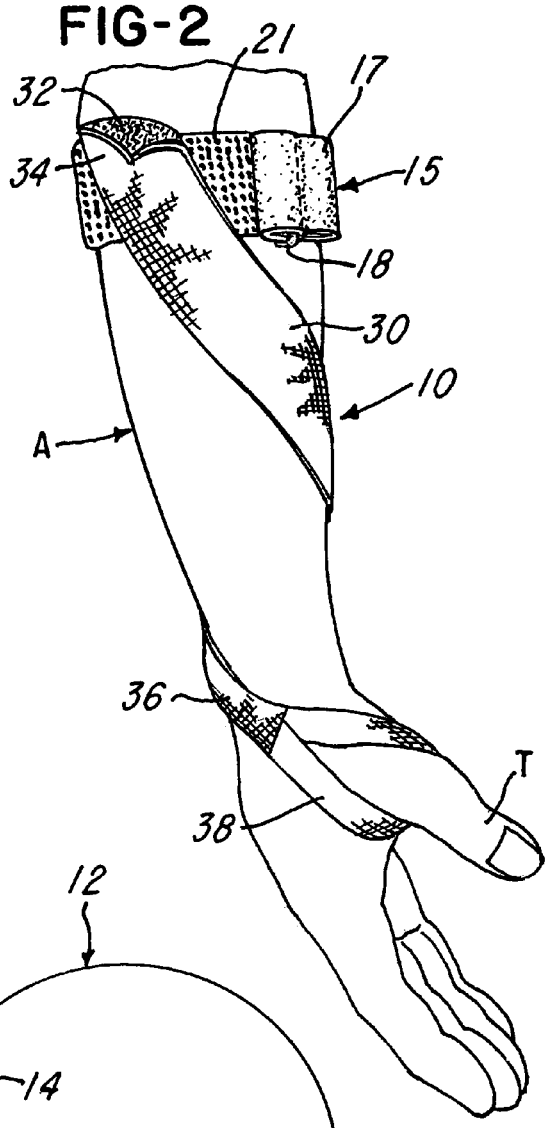
FIG. 2 is a perspective view similar to FIG. 1 but with the bowling ball removed.
Figure 3:
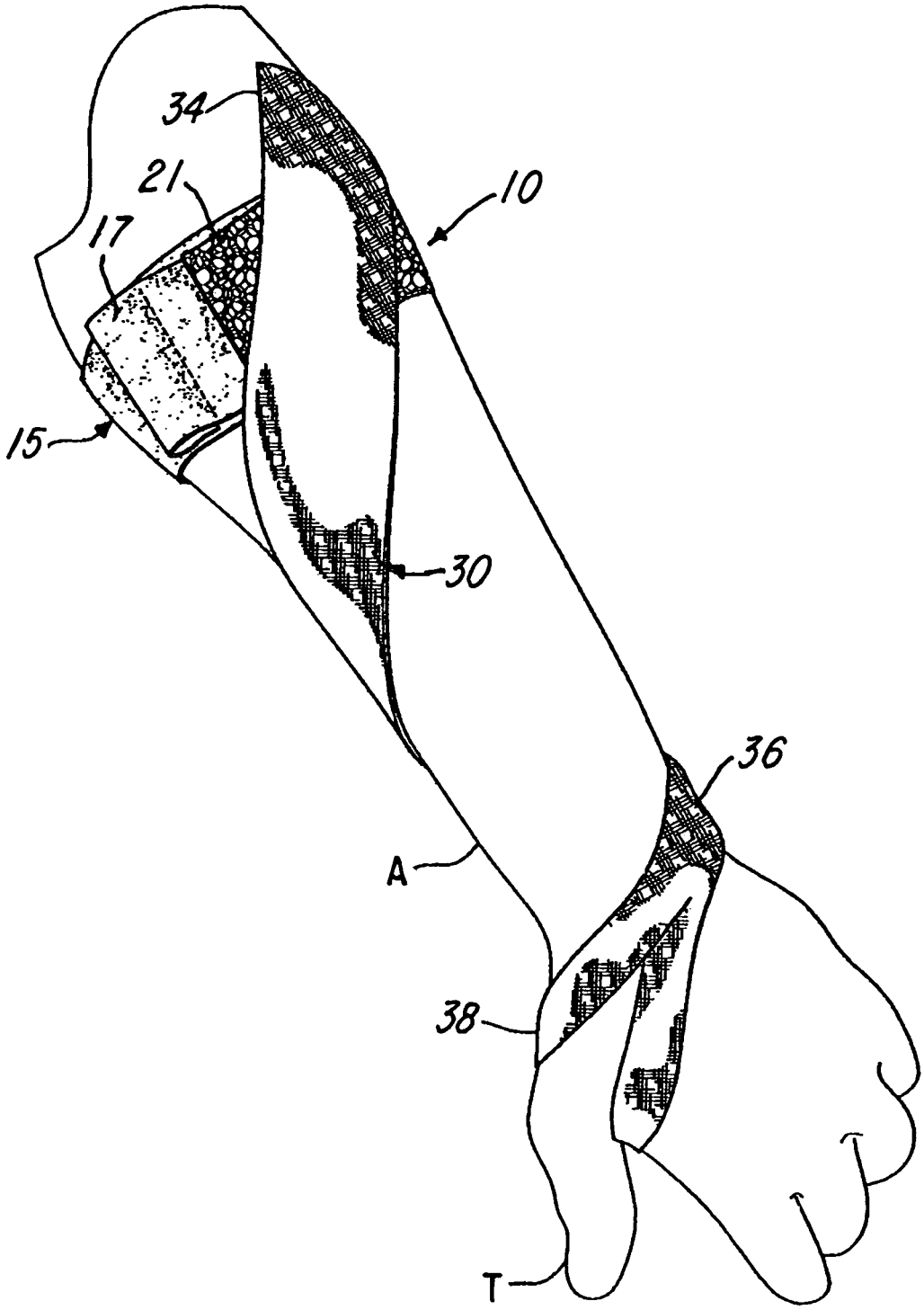
FIG. 3 is a perspective view of the left arm of a bowler and having a wrist rotation controller for the left arm and thumb in accordance with the present invention.
Figure 4:
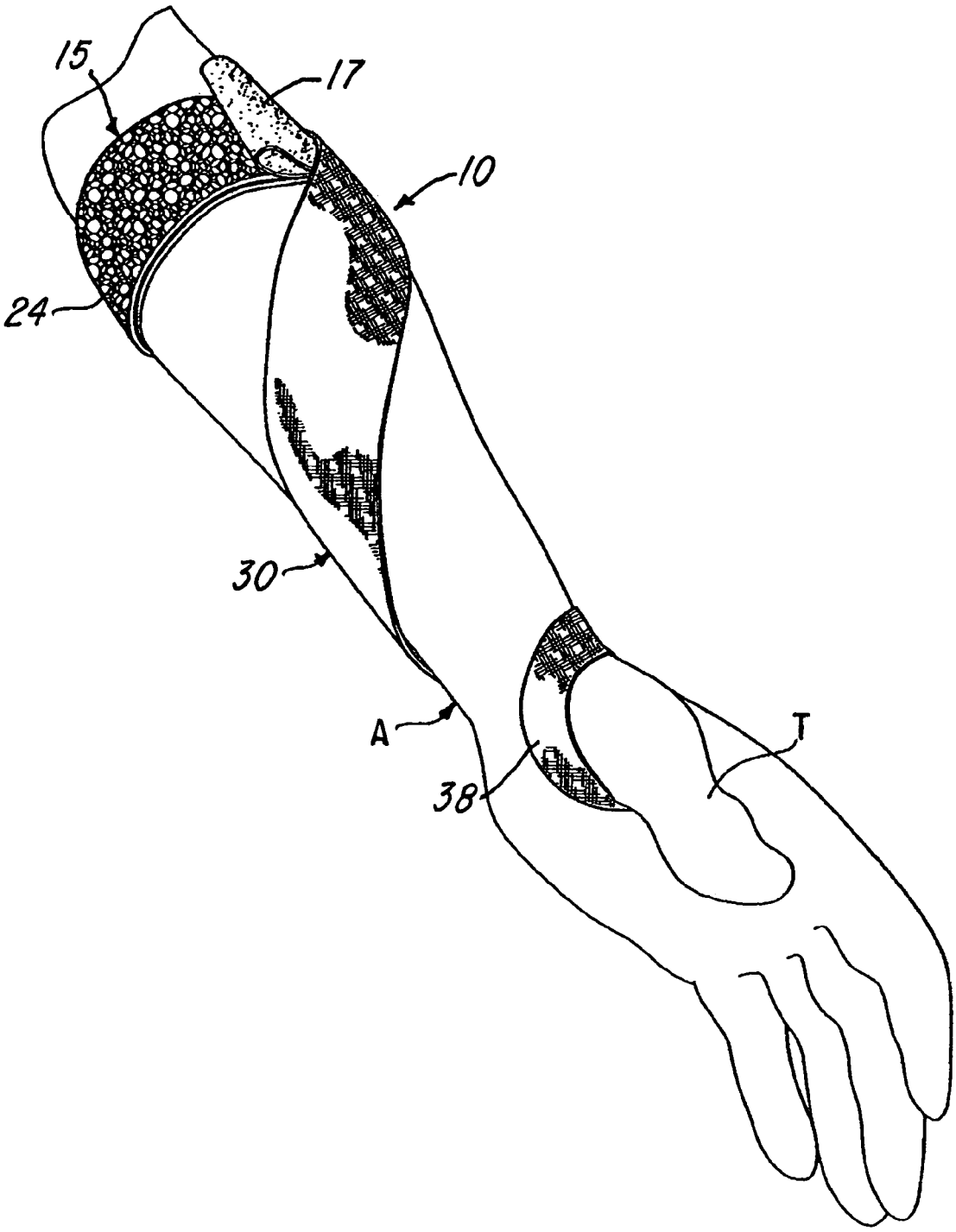
FIG. 4 is another perspective view of the left arm and wrist rotation controller for a bowler as seen from the bottom of the left arm according to the present invention.
Figure 5:
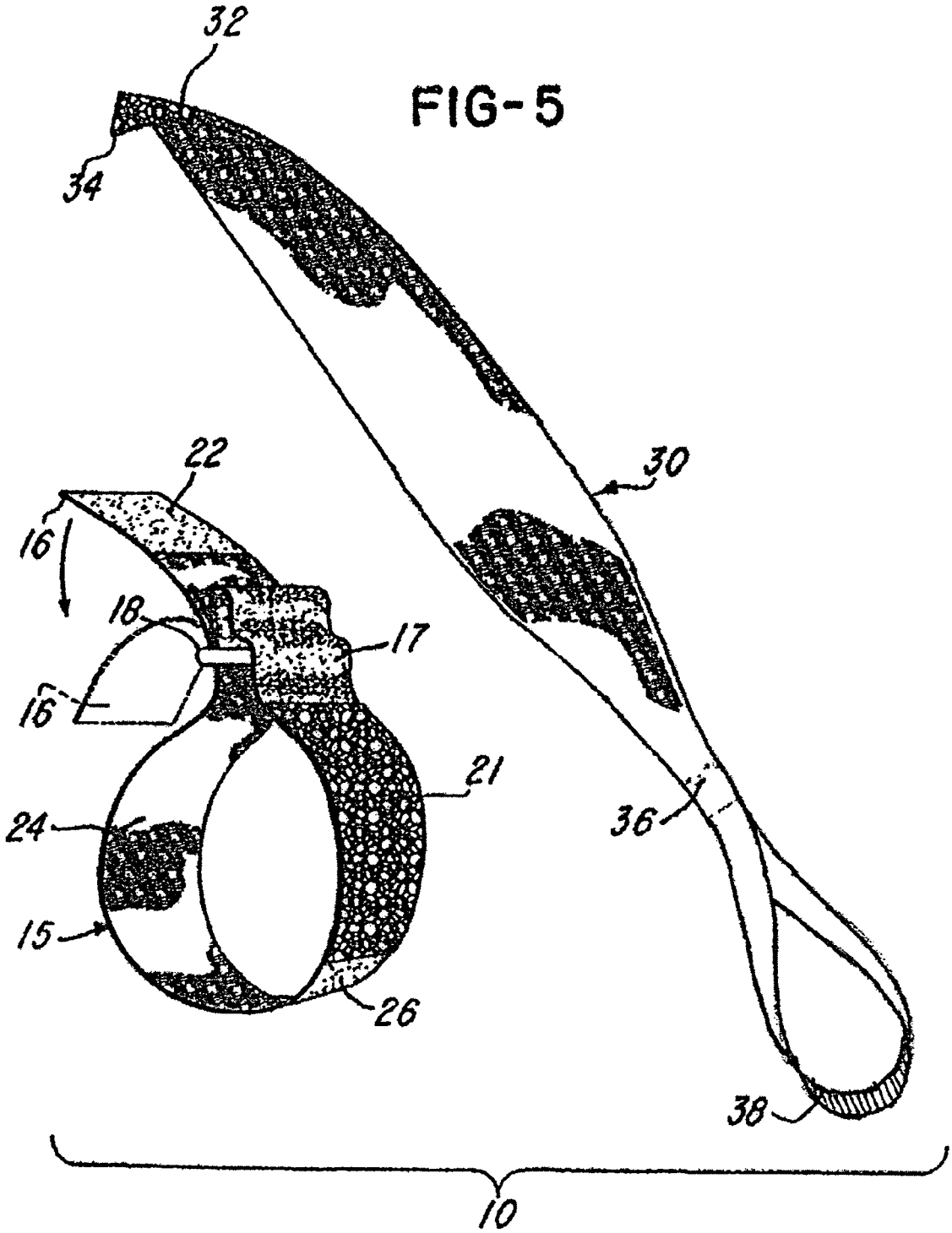
FIG. 5 is an exploded perspective view of the components or parts of the wrist rotation controller shown in FIGS. 1-4.

Referring to FIGS. 1 & 2, a wrist rotation controller 10 for a bowling ball. 12 having a thumb hole 14, includes an elastic and flexible multiple layer band 15 which wraps around the forearm of the throwing arm A of a bowler at a position adjacent and just below the elbow. The band 15 has a free end portion 16 (FIG. 5) and an opposite end portion 17 which is folded back on itself and extends through a rigid rectangular ring 18. The end portion 17 is stitched together on one side or opposite sides of the ring 18 so that the ring is captured by the end portion 17. Flexible strips 21 and 22 (FIG. 5) of hook fasteners of hook and loop fasteners, commonly sold under the trademark VELCRO, are attached or stitched to the outer surface of the band 15 with strip 22 forming the free end portion 16 and strip 21 attached adjacent the folded end portion 17 of the band 15. The inner surface of the band 15 is formed by a layer 24 (FIG. 5) of resilient and non-absorbent sponge-like material such as a Neoprene material. The band 15 has an outer layer 26 of elastic or stretchable fabric material which forms fuzzy loop fasteners of the hook and loop fasteners.

A flexible and non-stretchable elongated strap 30 has a width of at least two inches and fuzzy loop fasteners 32 on its entire inner side, extending to an upper or distal free end portion 34. A lower or proximate end portion 36 of the strap 30 is tapered down to a width of about one inch and is attached or stitched to a loop 38 of a non-stretchable fabric material having a width of about ⅝ inch.

In use, the elastic band 15 is positioned around the bowler's arm A just below the elbow, as depicted in FIG. 1. The free end 16 (FIG. 5) of the band is inserted through the ring 18 and pulled back on itself until the hooks on the strip 22 attach to the loops forming the outer surface of the band 15. The elastic band 15 is snugly secured to the arm by the hook and loop fasteners on the band. The loop 38 on the strap 30 is extended around on the thumb T, and the strap 30 is wrapped around the back of the wrist for restricting rotation of the wrist. If desired, the band 30 may be wrapped around the front of the wrist to enhance rotation of the wrist. The strap 30 continues upward in a spiral or helical manner around the arm A toward the band 15. The free end portion 34 of the strap 30 is then adjustably attached to band 12 by means of the loop fasteners on the inside of the strap 30 and the strip 21 of hook fasteners on outside of the band 15. After selecting the optimum connection of the strap 30 to the band 15, the assembly is effective to prevent or enhance wrist rotation during ball release.

It is to be understood that the present invention is not limited to the specific embodiment described above, but encompasses any and all embodiments within the scope of the following claims.

The invention claimed is:

1. A method of restricting the rotation of a bowler's hand upon release of a bowling ball while the ball is supported by the bowler's arm having a forearm extending from an elbow to a hand and thumb supporting the bowling ball with the thumb projecting into a thumb hole within the bowling ball, the method comprising the steps of surrounding the bowler's forearm at a position just below the elbow with an elongated adjustable band having an outer surface and forming the sole band surrounding the bowler's arm, extending an elongated non-stretchable flexible strap helically, continuously and completely around the bowler's forearm with the strap having a lower end portion and an upper end portion and a predetermined width, overlapping the outer surface of the band surrounding the bowler's forearm with an inner surface of the upper end portion of the strap, attaching the outer surface of the band and the inner surface of the strap with hook fasteners and loop fasteners to form an adjustable and positive connection of the upper end portion of the strap to the band, attaching a separate non-stretchable flexible loop member to the lower end portion of the strap with the loop member having a width substantially less than the width of the strap, extending the loop member around the bowler's thumb projecting into the thumb hole of the bowling ball, and adjusting the tension in the strap extending completely around the bowler's forearm by adjusting the hook and loop fasteners on the inner surface of the upper end portion of the strap and on the outer surface of the band for restricting the rotation of the hand supporting the bowling ball and the thumb projecting into the thumb hole during movement of the bowling ball with the arm and release of the bowling ball from the hand and thumb.

2. A method as defined in claim 1 and including the steps of locating the hook fasteners on the outer surface of the band and the loop fasteners on the inner surface of the strap, and projecting the upper end portion of the strap upwardly from the band to facilitate gripping the strap.

3. A method as defined in claim 1 and including the steps of forming the elongated band with an elastic inner layer, and attaching a strip of hook fasteners on the outer surface of the band.

4. A method as defined in claim 1 and including the step of locating the loop fasteners on the entire inner surface of the strap extending helically and completely around the bowler's forearm for contacting the forearm with the loop fasteners.

* * * * *